US007328473B2

(12) United States Patent
Deklinski

(10) Patent No.: US 7,328,473 B2
(45) Date of Patent: Feb. 12, 2008

(54) SWIMMING POOL VACUUM HOSE ATTACHMENT FOR SPOT CLEANING

(76) Inventor: Bryan C. Deklinski, 608 Water St., Shamokin, PA (US) 17872

( * ) Notice: Subject to any disclaimer, the term of this patent is extended or adjusted under 35 U.S.C. 154(b) by 395 days.

(21) Appl. No.: 10/996,649

(22) Filed: Nov. 24, 2004

(65) Prior Publication Data

US 2006/0085928 A1 Apr. 27, 2006

Related U.S. Application Data

(63) Continuation-in-part of application No. 10/972,948, filed on Oct. 25, 2004.

(51) Int. Cl.
*E04H 4/16* (2006.01)

(52) U.S. Cl. ..... 15/1.7

(58) Field of Classification Search ..... 15/1.7
See application file for complete search history.

(56) References Cited

U.S. PATENT DOCUMENTS 4,275,474 A 6/1981 Woodard
4,376,320 A 3/1983 Linda
4,637,086 A 1/1987 Goode
6,797,157 B2 * 9/2004 Erlich ..... 210/94
2004/0158943 A1 * 8/2004 Popielarczyk et al. ..... 15/1.7
2005/0108836 A1 * 5/2005 Rowan et al. ..... 15/1.7

* cited by examiner

*Primary Examiner*—Randall Chin
(74) *Attorney, Agent, or Firm*—Caesar, Rivise, Bernstein, Cohen & Pokotilow, Ltd.

(57) ABSTRACT

A spot cleaning device for a swimming pool cleaning system having a vacuum source and a vacuum hose having an end portion forming a vacuum inlet. The spot cleaning device is arranged to be coupled to vacuum hose and to a pole. The spot cleaning device includes a releasable connector for releasably mounting it on the pole. In one embodiment the device includes a hollow body to which the vacuum hose is coupled and which includes an inlet port which communicates with the inlet port of the vacuum hose. In another embodiment the device makes use of the vacuum hose's inlet port directly. When either device is coupled to the vacuum hose and mounted on the pole the inlet port can be positioned adjacent material, e.g., leaves, mud, algae, stones, etc., desired to be removed from the pool so that when the vacuum source is operated suction at the inlet port pulls that material directly into the inlet port without creating a cloud of debris.

9 Claims, 7 Drawing Sheets

SWIMMING POOL VACUUM HOSE ATTACHMENT FOR SPOT CLEANING

GROSS REFERENCE TO RELATED APPLICATIONS

This application is a Continuation-In-Part of U.S. patent application Ser. No. 10/972,948, filed on Oct. 25, 2004, now pending, entitled Swimming Pool Vacuum Hose Attachment for Spot Cleaning whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPUTER DISK

"Not Applicable"

BACKGROUND OF THE INVENTION

This invention relates generally to cleaning devices, and more particularly to devices for spot cleaning swimming pools and other chambers containing water or other liquids.

In U.S. Pat. No. 4,275,474 (Woodard) there is disclosed a vacuum head for a swimming pool cleaning system. The head is of the bristle-type for use particularly on vinyl liners, and the like, and comprises a wide, substantially shallow structure including an elongated top, walls and an outlet oriented upwardly from the top and communicating with the generally hollow interior of the head. The upright outlet forms a first connection for attachment of a vacuum hose to the head. A second hose of a diameter smaller than that of the first hose may be detachably positioned over an adapter member which is removably fitted within the first hose connection. Suction control in the form of at least one water by-pass valve is provided in the head top, enabling water sucked into the head interior to be selectively released therefrom, thereby preventing an excessively high suction force in the head intake area and such a force resulting from too great a build-up of vacuum within the cleaning system. Fixedly secured to the head top inner surface are a pair of axially opposed stabilizing weights and a connection for attachment of a handle or pole is provided at the top outer surface.

Other patents relating to devices for cleaning swimming pools are: U.S. Pat. No. 4,275,474 (Randall), U.S. Pat. No. 4,376,320 (Linda) and U.S. Pat. No. 4,637,086 (Goode).

While the aforementioned prior art devices may be suitable for their intended purposes they nevertheless leave something to be desired from one or more of the standpoints of simplicity of construction, easy of use and effectiveness. For example, some of such prior art devices when used to vacuum up finely dispersable debris, e.g., a dead algae pile, frequently create a cloud of such debris since the vacuum action is itself dispersed. To overcome that drawback of the prior art, persons cleaning pools have sometimes resorted to using the pole of a conventional pool vacuum head system, without the vacuum head, by merely attaching the distal end of the pole to the open distal end of the conventional vacuum hose via tape, e.g., duct tape. While such an arrangement enables effective spot vacuuming, the use of tape is undesirable and does not provide an elegant solution, e.g., untaping and retaping is messy, and time consuming.

SUMMARY OF THE INVENTION

In accordance with one aspect of this invention a spot cleaning vacuum head is provided for a swimming pool cleaning system including a vacuum source and a vacuum hose. The vacuum hose is coupled to the vacuum source and has a free end. The spot cleaning vacuum head comprises a body having a free end. The body comprises a releasable connector, a tubular section, an outlet port and an inlet port. The tubular section includes a sidewall having a longitudinal axis. The tubular section terminates in an opening defining the inlet port and forms the free end of the body. The outlet port is in fluid communication with the inlet port and is arranged to be releasably coupled to the free end of the vacuum hose. The releasable connector comprises a projecting member extending away from the tubular section at a shallow acute angle to the longitudinal axis. The projecting member is arranged to be releasably secured to an end portion of an elongated pole to mount the spot cleaning vacuum head on the pole, whereupon the spot cleaning vacuum head can be moved by manipulation of the pole into position within a swimming pool so that the free end of the body is below the surface of water within the pool and immediately adjacent material desired to be removed. The spot cleaning vacuum head is arranged so that when the vacuum source is operated suction is created at the inlet port to pull the material directly into the inlet port, thereby resulting in the spot cleaning of the swimming pool.

In accordance with another aspect of this invention a spot cleaning device is provided for use with a swimming pool cleaning system including a vacuum source and a vacuum hose. The vacuum hose is coupled to the vacuum source and has a free end in the form of an inlet port. The spot cleaning device comprises a body having a recessed surface adapted to receive a portion of the free end of the vacuum hose, releasable fastening means for releasably securing the portion of the free end of the vacuum hose on the recessed surface and a releasable connector. The releasable connector comprises a projecting member extending away from the body and being arranged to be releasably secured to an end portion of an elongated pole to mount the device on the pole, whereupon the inlet of the vacuum hose can be moved by manipulation of the pole into position within a swimming pool so that it is below the surface of water within the pool and immediately adjacent material desired to be removed, whereupon when the vacuum source is operated suction is created at the inlet port to pull the material directly into the inlet port, thereby resulting in the spot cleaning of the swimming pool.

DETAILED DESCRIPTION OF THE PREFERRED EMBODIMENT

Figure 1:
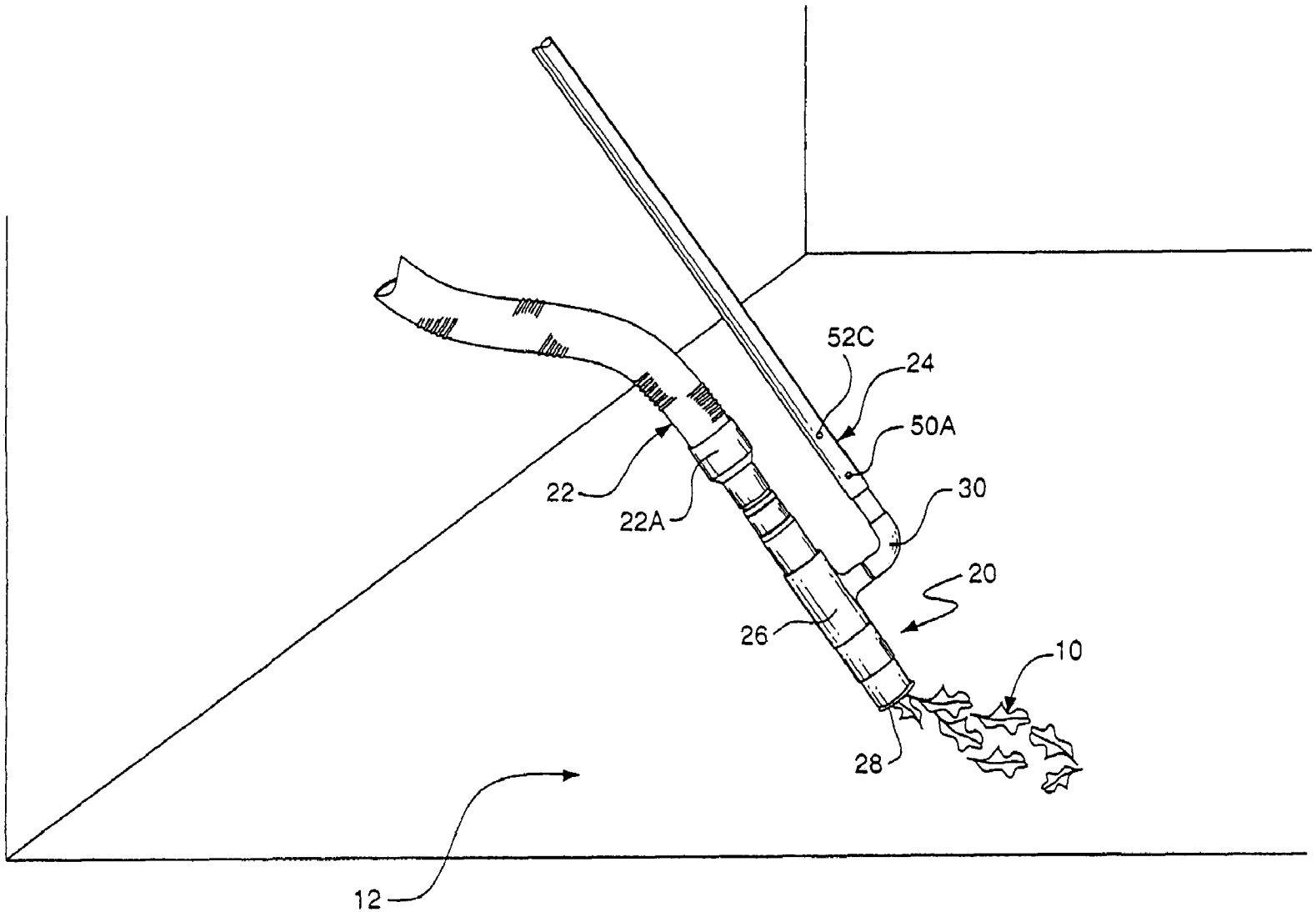
FIG. 1 is an isometric view of one exemplary preferred embodiment of a spot cleaning vacuum head constructed in accordance with this invention shown connected to a conventional vacuum hose and a conventional vacuum pole in the process of vacuuming debris, e.g., leaves, from the bottom of a filled swimming pool.

Referring now to the various figures of the drawing wherein like reference characters refer to like parts, there is shown at 20 in FIG. 1 a spot cleaning vacuum head constructed in accordance with one exemplary preferred embodiment of this invention. The spot cleaning vacuum head 20 is arranged for use with a conventional swimming pool filtration system including a source of vacuum (not shown), a flexible, e.g., corrugated, plastic vacuum hose 22 and a conventional elongated pole 24. The vacuum hose 22 includes a proximal end, not shown, which is arranged to be releasably secured to the vacuum source and to some vessel or receptacle (not shown) for collecting debris that has been removed from the pool. The distal end of the hose 22 is in the form of a female connector or collar 22A. Such collars are conventional circular tubular members whose distal or free end is of either 1½ inch (38.6 mm) inside diameter or 1¼ inch (31.5 mm) inside diameter. The pole 24 is also a conventional device like that used to releasably mount a conventional swimming pool vacuum head thereon. The pole is an elongated linear member, formed of any suitable material, such as a plastic (PVC) or aluminum. The pole is preferably tubular, i.e., includes a circular sidewall, in the interest of being light in weight, yet rigid and strong.

The distal end of the pole includes at least one aperture extending through the sidewall of the pole for receipt of a spring biased extending member or finger (to be described later) of the spot cleaning vacuum head 20 to releasably mount the head on the pole (as shown in FIG. 1, and as will be described in detail later). In fact, in accordance with one exemplary embodiment of this invention, there are two pairs of spring biased members or fingers forming a portion of the spot cleaning vacuum head. Such an embodiment makes use of a pole having a distal end which includes two pair of diametrically aligned apertures spaced longitudinally apart and located in the distal end portion of the pole. In particular, one pair of apertures 24A and 24B (FIG. 5) is located close to the distal end of the pole 24 and a second pair of apertures 24C and 24D (FIG. 5) is spaced slightly proximally of the first pair of apertures 24A and 24B.

Figure 3:
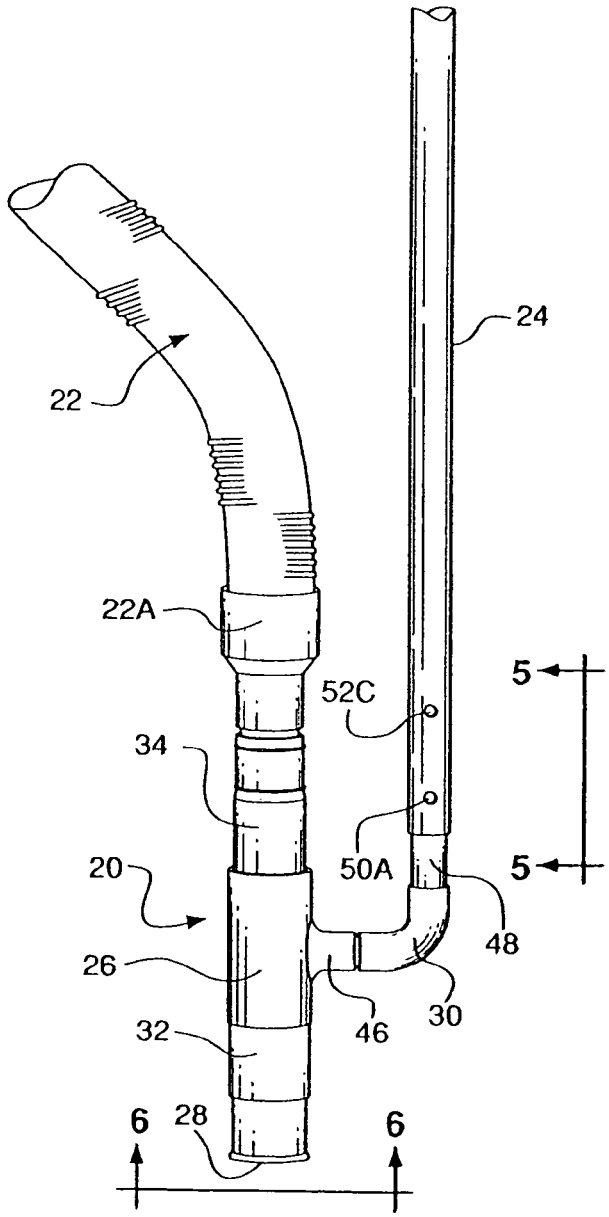
FIG. 3 is a front elevation view of the embodiment of the spot cleaning vacuum head shown in FIGS. 1 and 2.
Figure 4:
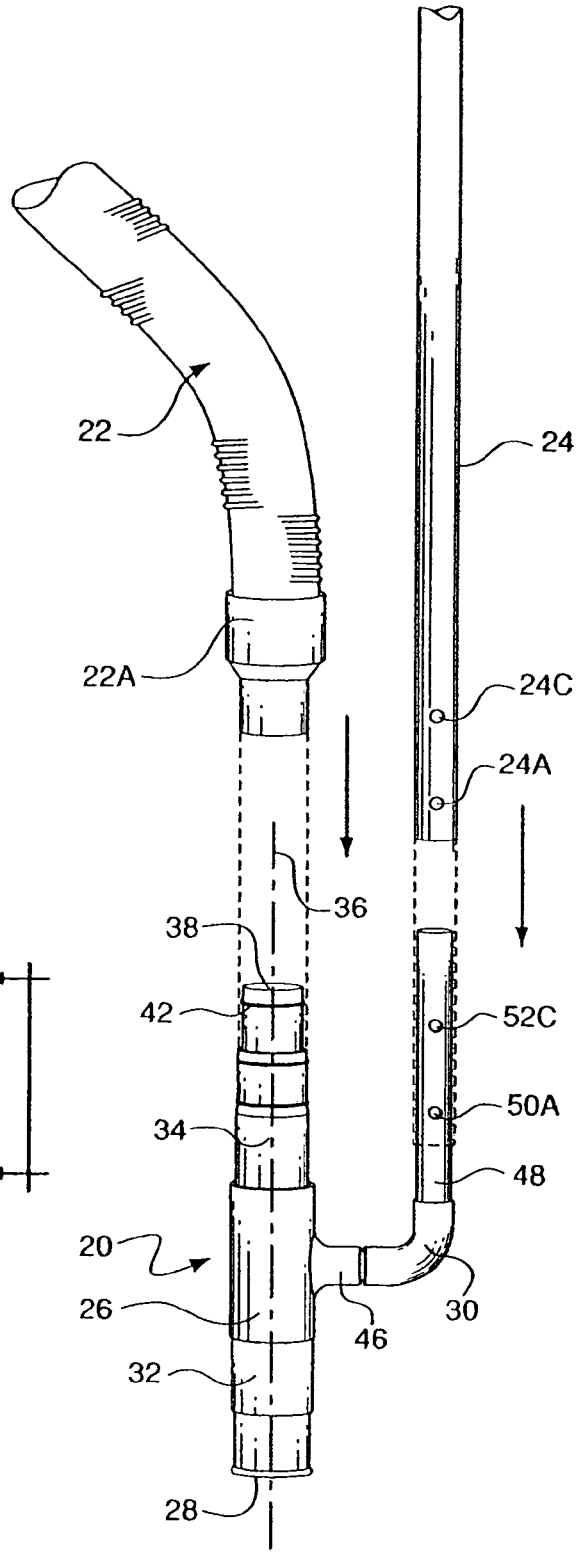
FIG. 4 is an exploded front elevation view of the spot cleaning vacuum head shown in FIGS. 1 and 2 showing how the components of the spot cleaning vacuum head are connected together and to the conventional vacuum hose.

The spot cleaning vacuum head 20 basically comprises a hollow body 26 formed of any suitable material, e.g., PVC piping, and has a free end 28. As best seen in FIGS. 3 and 4, the body 26 includes a releasable connector 30, a first tubular section 32 and a second tubular section 34. As will be described later, the tubular sections are axially aligned along a longitudinal axis 36 (FIG. 4). The first tubular section 32 has an inlet port 28. The second tubular section 34 has an inlet port (not shown) and an outlet port 38 (FIG. 4). The second tubular section includes a sidewall having a longitudinal axis extending coincident with the longitudinal axis 36. The first tubular section 32 terminates at an opening at the free end 28 that forms the inlet port 40. The inlet port 40 is located at the free (distal) end of the body 26 to enable the vacuum head to create a concentrated and directed vacuum, e.g., a "spot" vacuum, to the debris to be removed from the pool.

Figure 2:
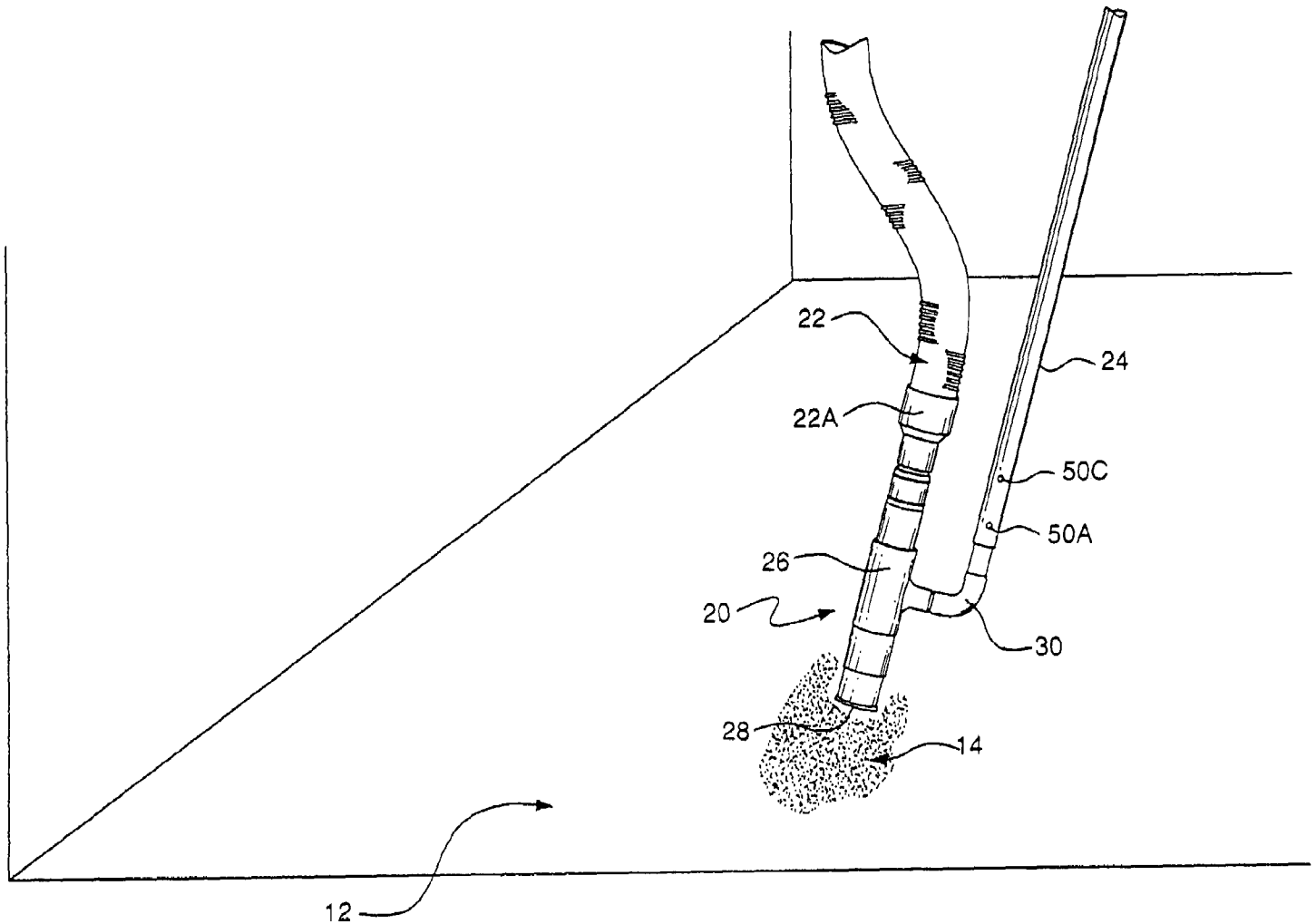
FIG. 2 is an isometric view similar to FIG. 1, but showing the spot cleaning vacuum head in the process of vacuuming a pile of dead algae from the bottom of the filled swimming pool, without disrupting the algae pile so as to create a cloud of dead algae.

The second tubular section 34 also includes a sidewall having a longitudinal axis extending coincident with the longitudinal axis 36 and terminating in an opening that forms the outlet port 38. The outlet port 38 is in fluid communication with the inlet port 40 through the hollow interior of the body 36 of the spot cleaning vacuum head 20. The outside diameter of the portion of the second tubular section forming the outlet port is either 1½ inch (38.6 mm) or 1¼ inch (31.5 mm). This enables it to be readily releasably received in the collar 22A of the vacuum hose 22 as shown in FIGS. 1-3 to mount the spot cleaning vacuum head 20 on the vacuum hose 22. A circular ridge 42 extends about the periphery of the second section 34 adjacent the outlet port 38 to form a good seal when the portion of the second tubular section forming the outlet port is connected to the vacuum hose 22.

Figure 6:
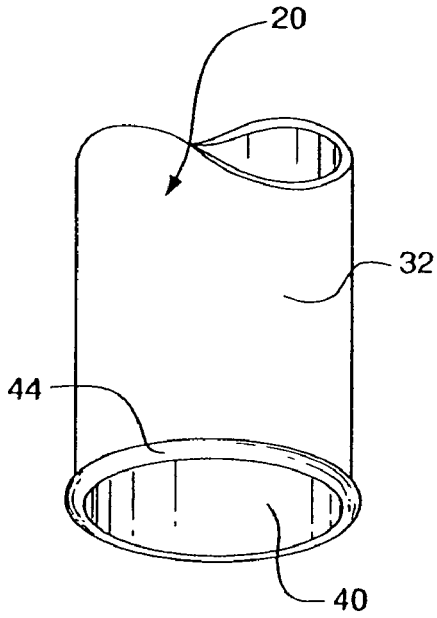
FIG. 6 is an enlarged end view taken along line 6-6 of FIG. 3.

The distal end of the first tubular section 32 forming the inlet port is preferably formed of a resilient or soft material, e.g., it is rubberized. This forms an atraumatic tip for the spot cleaning vacuum head to minimize the chance that the vacuum head will damage the pool liner if it is used to clean an above ground pool. To further ensure that the tip will not damage the pool liner, the free distal end of the second section contiguous with the inlet port 40 preferably includes an annular bead 44 extending thereabout as shown in FIG. 6. As should be appreciated by those skilled in the art the distal end of the tip can be beaded, like shown, and be rubberized or otherwise formed of a soft, atraumatic material, or may be formed of the same material as that forming the tubular section 32. In fact, the distal end of the second tubular section at the inlet may not be beaded and/or formed of an atraumatic material if desired.

Turning now to FIGS. 3 and 4, the details of the releasable connector 30 will now be described. That connector is in the form of a projecting member extending outward from the body 26. In particular, the projecting member releasable connector includes a first portion 46 and a second portion 48. The first portion 46 extends outward in a radial direction from the sidewall making up the body 26 and is perpendicular to the longitudinal axis 36. The first portion 46 of the projecting member releasable connector 30 is fixedly secured to the body 26. The second portion of the releasable connector 30 is of an elongated, cylindrical shape and extends parallel to the longitudinal axis 36. In the interest of weight the first 46 and second 48 portions of the releasable connector 30 are hollow, e.g., tubular members. The outside diameter of the second portion 48 of the releasable connector 30 is just slightly smaller than the inside diameter of the hollow distal end of the pole 24.

Figure 5:
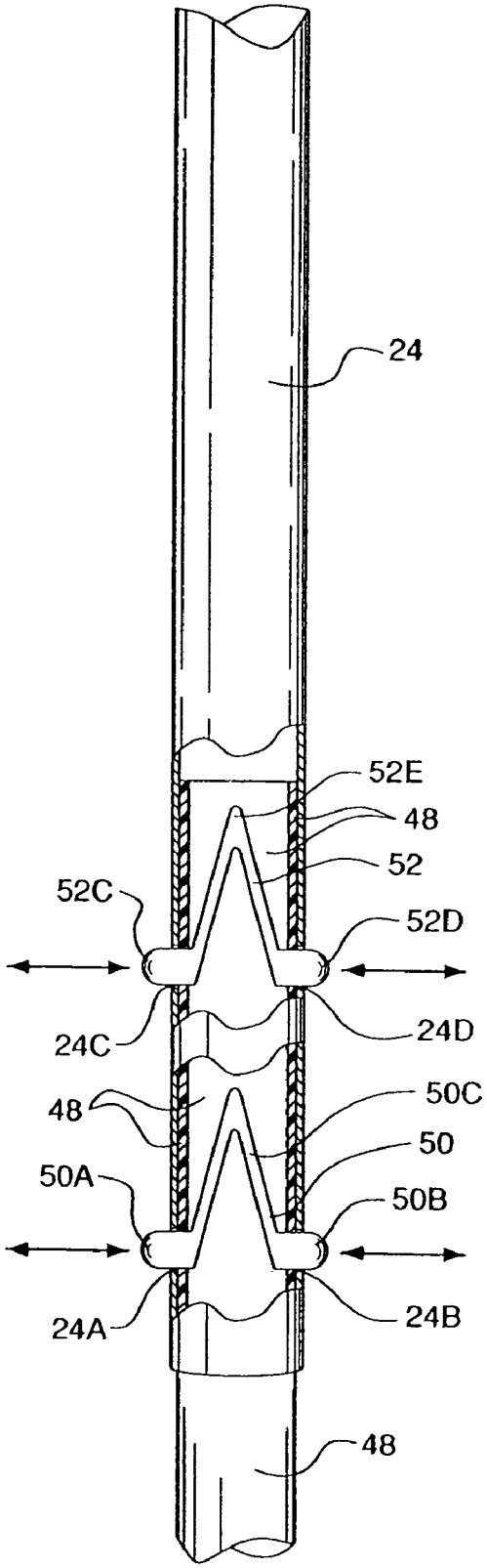
FIG. 5 is an enlarged view, partially in section, taken along lines 5-5 of FIG. 3.

As best seen in FIG. 5, the second portion 48 of the releasable connector 30 includes two conventional butterfly-like, spring-biased locking members 50 and 52 located therein. The locking member 50 basically comprises a pair of projecting fingers 50A and 50B fixedly mounted on respective ones of a pair of legs of a V-shaped spring 50C. Preferably the fingers 50A and 50B and the V-shaped spring are formed as an integral unit of any suitable material, e.g., plastic or metal.

The fingers 50A and 50B are biased by the spring 50C to extend outward through the sidewall of the second portion 48 of the connector 30 for releasable location within the apertures 24A and 24B, respectively, in the pole 24 when spot vacuum head 20 is mounted on the pole 24. The locking member 52 is constructed similarly to locking member 50. Thus, it basically comprises a pair of projecting fingers 52C and 52D fixedly mounted on respective ones of a pair of legs of a V-shaped spring 52E. The fingers 52C and 52D are biased by the spring 52E to extend outward through the sidewall of the second portion 48 of the connector 30 for releasable location within the apertures 24C and 24D, respectively, when spot vacuum head 20 is mounted on the pole 24.

The securement of the spot cleaning vacuum head onto the pole is achieved by inserting the second portion 48 of the connector 30 into the hollow distal end of the pole 24, whereupon the domed ends of the fingers 52C and 52D of the locking member 52 rides over the free distal edge of the pole to cause the fingers to move inward and to remain in that inward position as the free end of the sidewall of the pole passes over them. Continued movement of the second portion 48 of the connector 30 into the pole 24 causes the fingers 50A and 50B of the locking member 50 to retract in the sane way as they pass the free distal edge of the pole. When the fingers 52C and 52D of the locking member 52 to reach the diametrically aligned apertures 24C and 24D, as the fingers 50A and 50B to reach the diametrically aligned apertures 24A and 24B, the fingers snap-fit into their respective apertures, thereby releasably securing the spot cleaning vacuum head 20 on the pole 24.

Once the vacuum head is so mounted and connected to the vacuum hose 22, as discussed above, it is ready to spot clean any portion of the pool. To that end, the user grasps the proximal end of the pole 24 and submerses the distal end on which the spot cleaning vacuum head 20 is mounted into the water in the pool so that the inlet port 40 is located immediately adjacent the debris or other material to be removed. In FIG. 1 debris is shown in the form of leaves 10 located on the floor of a pool 12. With the inlet port 40 of the vacuum head being located immediately adjacent, when the vacuum source is turned on the vacuum produced thereby is coupled through the hose and the hollow interior of the vacuum head 20, so that a confined and axially directed vacuum is created at the outlet port 40. This action pulls the leaves 10 directly into the inlet port, from whence they are carried through the interior of the vacuum head and the vacuum hose 24 for collection. The directed vacuum at the inlet port also tends to minimize the tendency of the leaves from billowing to form a cloud of dispersed leaves. The formation of a cloud of dispersed leaves is obviously undesirable, since it will require further vacuuming to remove them. In FIG. 2, the spot cleaning vacuum head 20 is shown being used to remove a pile of dead algae 14 which has accumulated on the floor of the pool. As will be appreciated by those skilled in the art, the ability of the spot cleaning vacuum head of this invention to direct the vacuum to its distally located inlet 28, is particularly useful for spot cleaning of algae or other readily disposable materials, since it is quite easy to create a cloud of dead algae or other dispersable materials if a more diffused vacuum head, like those of the prior art is used.

Figure 7:
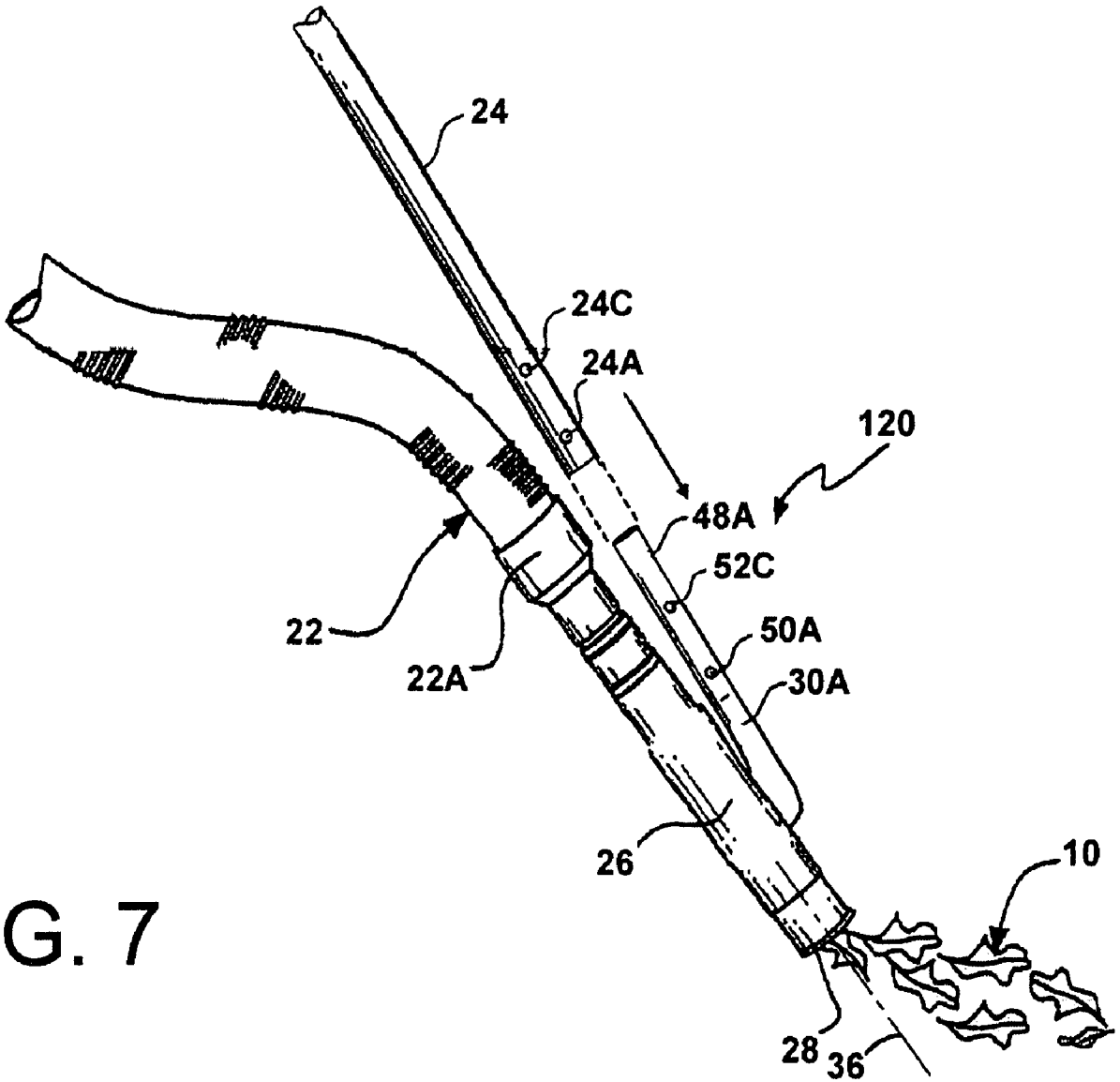
FIG. 7 is a view similar to FIG. 1 but showing an alternative embodiment of this invention.

In FIG. 7 there is shown an alternative embodiment 120 of the device of this invention. That device is basically similar to the device 20 shown in FIG. 1, except that the releasable connector of this device, designated by the reference number 30A, is not in the form of a right angled conduit like connector 30 of device 20. In the interest of brevity the features of the device 120 that are the same as those of the device 20 will be given the same reference numbers and the details of those features and their operation will not be reiterated. Thus, as can be seen in FIG. 7 the releasable connector 30A is in the form of a tubular section 48A extending outward at a shallow acute angle from the longitudinal axis 36 of body 26. The releasable connector 30A is fixedly secured to the body 26 so that the passageway extending there through communicates with the interior of the body 26. The outside diameter of the free end portion of the tubular section 48A is just slightly smaller than the inside diameter of the hollow distal end of the pole 24 so that it can fit therein and be locked in place by the locking members and associated holes as described above with respect to device 20.

Figure 8:
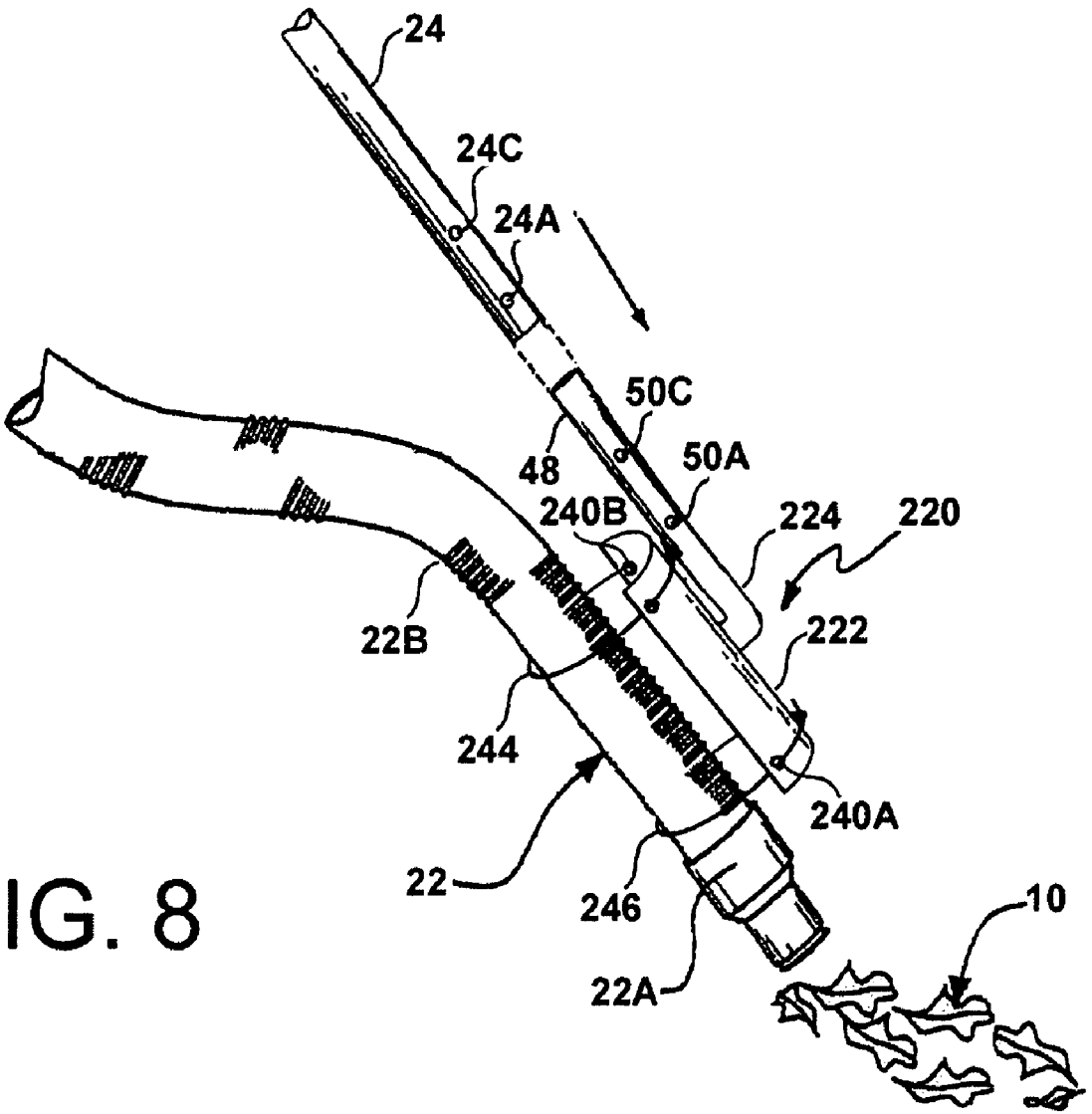
FIG. 8 is a view similar to FIG. 1 but showing still another alternative embodiment of this invention.
Figure 9:
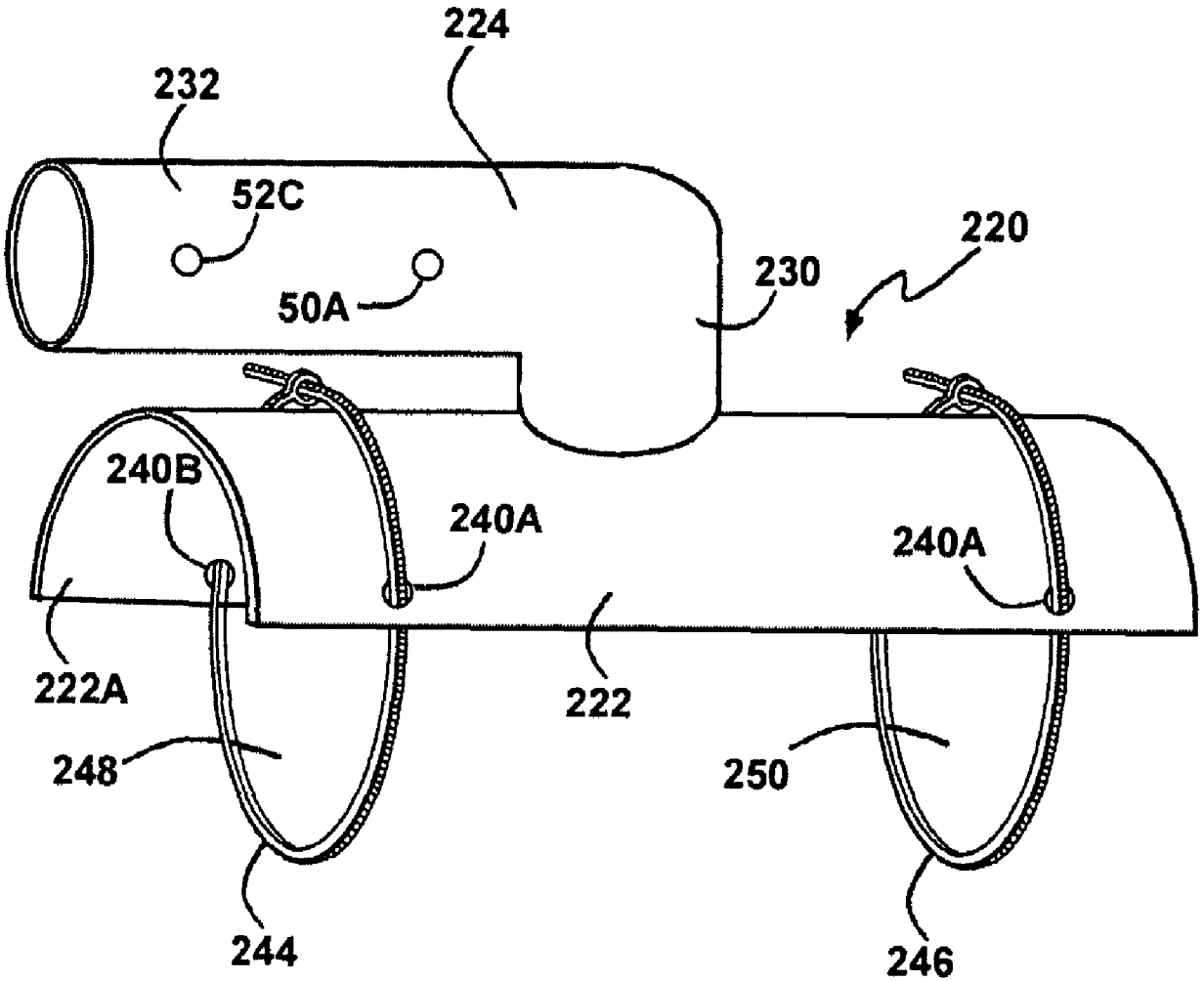
FIG. 9 is an enlarged view of the embodiment of the invention shown in FIG. 8.

In FIGS. 8 and 9 there is shown another alternative embodiment of a device 220 of this invention. The device 220 is somewhat different than the devices 20 and 120, in that it does not include a body 26 with an inlet and outlet port. Rather the device 220 is arranged to releasably mount the free end of the vacuum hose 22 so that the open end of the collar 22A serves as an inlet port for effecting spot cleaning directly. To that end, as can be seen the device 220 basically comprises a trough-shaped body 222, a tubular connector 224, and a pair of releasably securable fasteners (to be described later). The trough-shaped body 222 and the tubular connector are formed as an integral unit and may be of the same material, e.g., a molded plastic, as used to make the devices of devices 20 and 120. In any case the trough-shaped body 222 is of generally semi-circular cross section, having an inside hose-receiving surface 222A, whose diameter is approximately equal to the outside diameter of the corrugated portion 22B of the vacuum hose 22. This arrangement enables the inside surface of the trough-shaped body 222 to receive and accommodate a portion of the corrugated portion 22B vacuum hose 22 contiguous with the collar 22A. It should be pointed out at this juncture that the vacuum hose need not be corrugated. In any case the device 220 is arranged to receive and hold the portion of the vacuum hose immediately adjacent its open free end, e.g., collar.

As best seen in FIG. 9, the tubular connector 224 is a generally L-shaped tube which is fixedly secured to the trough-shaped body 222. In particular, the tubular connector 224 includes first portion 230 that extends outward in a radial direction from the trough-shaped body 222 and is fixedly secured to the body. A second portion 232 of the connector 30A is of an elongated, cylindrical shape and extends parallel to the longitudinal axis of the trough-shaped body. The portion 232 is constructed similarly to section 48 of the device 20, e.g., it includes the locking members that are arranged to snap-fit into the holes in the lower portion of the pole 24 in the same manner as described earlier.

In order to releasably mount the free end of the vacuum hose 22 to the device 220, the device includes two pairs of openings 240A and 240B. Each pair of openings is arranged to receive a respective one of a pair of strap-like connecting members which make up the releasably securable fasteners mentioned above. One pair of openings is located adjacent one end of the trough-shaped body. The other pair is located adjacent the opposite end of the trough-shaped body.

In accordance with one preferred embodiment of the device 220, a pair of conventional nylon cable ties 244 and 246 serve as the strap-like connecting members. Each tie is of conventional construction. As can be seen in FIG. 9, the tie 244 is arranged to be extended through the openings

240A and 240B at one end of the trough-shaped body 222 to form a loop 248 through which a portion 22B of the vacuum hose 22 can be extended (see FIG. 8). The other tie 246 is arranged to be extended through the openings 242A and 242B at the other end of the trough-shaped body 222 to form a loop 250 through which an adjacent portion 22B of the vacuum hose 22 can be extended (see FIG. 8). The ties can be tightened to hold the vacuum hose tightly in place against the underside surface 222A of the trough-shaped body 222.

The lower end of the pole 24 is arranged to be snap-fit to the connector 30A, like described earlier, whereupon the user can then use the device 220 to direct the collar 22A of the vacuum hose to the debris 10 to effect the spot cleaning of the pool in the same manner as described previously, except that the debris directly enters the vacuum hose 22 via the collar 22A, i.e., the open end of the collar serves as the inlet port.

While the embodiment 220 is shown making use of conventional nylon cable ties, other means for releasably securing the vacuum hose to the interior surface of the trough-shaped body 222 can be utilized, e.g., VELCRO® fastening straps, rubber bands, etc. Depending upon the fasteners used, the openings 240A and 240B.

As should be appreciated from the discussion above that the subject invention offers the pool owner or cleaner the ability to utilize a conventional hose to effect spot vacuuming of debris or other unwanted materials located below the surface of the water in the pool without creating a cloud of dispersed debris/material. Among the debris/materials, the subject invention can be used to pick up are leaves, rocks, mud, dead algae, etc.

While the invention has been described in detail and with reference to specific examples thereof, it will be apparent to one skilled in the art that various changes and modifications can be made therein without departing from the spirit and scope thereof.

I claim:

1. In combination a spot cleaning device and a swimming pool water system, said swimming pool water system including a vacuum source and a vacuum hose, said vacuum hose being coupled to said vacuum source and having a free end in the form of an inlet port, said spot cleaning device consisting of a releasable connector, releasable fastening means and a linear tubular body, said linear tubular body having a longitudinal axis, an inlet port at one end of said body and an outlet port at an opposite end of said body, said inlet port of said body forming the free end of said body, said body being of substantially the same cross sectional area between said inlet port and said outlet port and being adapted to receive a portion of said free end of said vacuum hose, said releasable fastening means being arranged for releasably securing said portion of said free end of said vacuum hose to said body, said outlet port being of substantially the same cross sectional area as said inlet port, said releasable connector comprising a projecting member extending away from said tubular body and being arranged to be releasably secured to an end portion of an elongated pole to mount said spot cleaning device on said pole, whereupon said inlet port of said vacuum hose can be moved by manipulation of the pole into position within a swimming pool so that it is below the surface of water within the swimming pool and immediately adjacent material desired to be removed, whereupon when said vacuum source is operated a confined and axial directed vacuum is created at said inlet port to pull the material directly into said inlet port along said longitudinal axis to minimize the tendency of the material from billowing to form a cloud of dispersed material, thereby resulting in the spot cleaning of the swimming pool.

2. The combination of claim 1 wherein the sidewall at the distal end portion of the pole includes at least one aperture and wherein said projecting member comprises at least one spring biased member arranged to snap-fit into the at least one aperture.

3. The combination of claim 1 wherein the pole comprise at least one pair of apertures extending through the sidewall at the distal end portion of the pole, with the apertures being diametrically aligned and wherein the projecting member comprises a pair of spring biased members arranged to be releasably snap-fit into respective ones of the apertures.

4. The combination of claim 1 wherein said portion of said vacuum head forming said inlet port comprises a soft or deformable material.

5. The combination of claim 4 wherein said portion of said vacuum head forming said inlet port is rubberized.

6. The combination of claim 1 wherein said outlet port is configured to be releasably secured to a conventional 1 ½ inch (38.6 mm) vacuum hose collar.

7. The combination of claim 1 wherein said outlet port is configured to be releasably secured to a conventional 1 ¼ inch (31.5 mm) vacuum hose collar.

8. The combination of claim 1 wherein the pole includes a hollow distal end portion having a sidewall, and wherein said projecting member of said releasably connector is arranged to be releasably received within the hollow distal end portion of the pole.

9. The combination of claim 8 wherein the sidewall at the hollow distal end portion of the pole includes at least one aperture and wherein said projecting member comprises at least one spring biased member arranged to snap-fit into the at least one aperture.

* * * * *